US007267639B2

(12) United States Patent
Kuo

(10) Patent No.: US 7,267,639 B2
(45) Date of Patent: Sep. 11, 2007

(54) COMPOUND BICYCLE EXERCISING DEVICE

(76) Inventor: Hai Pin Kuo, No. 15, Lane 833, Wen Hsien Road, Tainan 70459 (TW)

( * ) Notice: Subject to any disclaimer, the term of this patent is extended or adjusted under 35 U.S.C. 154(b) by 416 days.

(21) Appl. No.: 11/075,298

(22) Filed: Mar. 8, 2005

(65) Prior Publication Data

US 2006/0234835 A1 Oct. 19, 2006

(51) Int. Cl.
*A63B 22/12* (2006.01)
*F16H 27/02* (2006.01)

(52) U.S. Cl. ..... 482/62; 482/72; 74/126

(58) Field of Classification Search ..... 482/51, 482/57, 62, 72, 137, 138; 74/112, 118, 126, 74/129–132
See application file for complete search history.

(56) References Cited

U.S. PATENT DOCUMENTS 968,355 A * 8/1910 Hopkins et al. ..... 280/241
4,660,826 A 4/1987 Lee ..... 272/73
4,923,193 A * 5/1990 Pitzen et al. ..... 482/63
5,050,864 A * 9/1991 Pertramer ..... 482/51
5,114,391 A * 5/1992 Pitzen et al. ..... 482/62
5,501,648 A * 3/1996 Grigoriev ..... 482/57
5,836,856 A * 11/1998 Mattoo et al. ..... 482/62
5,992,253 A 11/1999 Petersen ..... 74/132
6,361,479 B1 * 3/2002 Hildebrandt et al. ..... 482/72
6,790,162 B1 * 9/2004 Ellis et al. ..... 482/51

* cited by examiner

*Primary Examiner*—Jerome Donnelly
*Assistant Examiner*—Tam Nguyen
(74) *Attorney, Agent, or Firm*—Charles E. Baxley

(57) ABSTRACT

A compound bicycle exercising device includes two foot pedals rotatably attached to a base, for being operated by users, two handle stems pivotally attached to the base, for being rotated by the users, and two rotary members secured to each handle stem. A spindle is rotatably supported on the base, and includes two followers rotatably attached to each end with unidirectional bearings. Two coupling members couple the rotary members to the followers, and a rotary element is engaged between one of the rotary members and one of the followers, to allow the spindle to be rotated in different direction relative to the rotary member, and to allow the spindle to be continuously driven by the handle stems via the followers and the rotary members alternatively, when the handle stems are rotated relative to the pivot axle in reciprocating action.

10 Claims, 8 Drawing Sheets

COMPOUND BICYCLE EXERCISING DEVICE

BACKGROUND OF THE INVENTION

1. Field of the Invention

The present invention relates to a compound bicycle exercising device, and more particularly to a compound bicycle exercising device having a coupling or transmission device for rotating or driving a spindle by both pushing or moving the handle stems forwardly and pulling the handle stems rearwardly.

2. Description of the Prior Art

Typical compound bicycle exercising devices comprise a transmission box driven by foot pedals, and a handle pivotally coupled to the transmission box, for allowing the handle to be rotated inwardly and outwardly, and for allowing users to conduct pedal driving or cycling exercises and hand operating exercises simultaneously.

For example, U.S. Pat. No. 4,660,826 to Lee discloses one of the typical compound bicycle exercising devices which also comprises a pair of foot pedals provided to be rotated or driven by the users, and a transmission box driven by the foot pedals to make a rotating bush at its output shaft and to drive a universal joint, in order to drive a saddle supporter and to move the saddle forward and backward. In addition, a number of connecting rods may couple the universal joint to two handles, to turn the handles inward and outward.

However, the handles are directly and simultaneously coupled to the saddle supporter, such that the handles will be moved forward and backward simultaneously while being pulled or driven or actuated by the users, and such that the handles may not be pulled and pushed or operated by the users alternatively to drive the typical compound bicycle exercising devices.

U.S. Pat. No. 5,992,253 to Petersen discloses another typical compound bicycle exercising device which is provided for converting reciprocating motion to a single direction rotational motion, and which comprises two pinions mounted on two one-way clutches respectively, and two racks engaged with the pinions respectively, to drive the shaft when the two racks are moved alternatively. The racks are pivotally coupled to two handles or exercise arms respectively, for being moved or operated by the handles or exercise arms.

However, the racks should be moved in the driving direction and/or the reciprocal direction at a rate of speed sufficiently fast to overtake the shaft, such that the handles should also be moved or rotated or operated at a rate of speed sufficiently fast to overtake the shaft and may not be suitably operated by the users by their own will.

The present invention has arisen to mitigate and/or obviate the afore-described disadvantages of the conventional compound bicycle exercising devices.

SUMMARY OF THE INVENTION

The primary objective of the present invention is to provide a compound bicycle exercising device including a coupling or transmission device for rotating or driving a spindle by both pushing or moving the handle stems forwardly and pulling the handle stems rearwardly.

In accordance with one aspect of the invention, there is provided a compound bicycle exercising device comprising a base, a pair of foot pedals rotatably attached to the base with a spindle and cranks, for being operated by users, a pair of handle stems each having a lower portion pivotally attached to the base with a pivot axle, for being pulled and pushed and operated in reciprocating action by the users, the handle stems each including an upper portion, a first rotary member and a second rotary member secured to the lower portions of the handle stems respectively, and rotated in concert with the handle stems relative to the pivot axle respectively, for allowing the first and the second rotary members to be rotated relative to the pivot axle by the handle stems respectively, a spindle rotatably supported on the base, and including two end portions each having a first follower and a second follower rotatably attached thereon with unidirectional bearings, a first coupling member and a second coupling member coupled to the first and the second rotary members and the first and the second followers respectively, and a rotary element engaged with the first coupling member, and arranged to have the spindle and the first rotary member to be rotated in different direction, and to allow the spindle to be continuously rotated and driven by the handle stems via the first and the second followers and the first and the second rotary members alternatively, when the handle stems are rotated relative to the pivot axle in reciprocating action.

The handle stems each preferably includes a barrel secured to the lower portion thereof, and the first and the second rotary members are secured on the barrel and thus secured to the handle stems and rotated in concert with the handle stems respectively. The handle stems each includes a handgrip attached to the upper portion thereof, and arranged to allow the handle stems to be easily operated by the users when pushing forwardly away and rearwardly toward the users.

The base includes a first wheel rotatably supported thereon, and the spindle includes a second wheel secured thereto and rotated in concert with the spindle and coupled to the first wheel, to allow the first wheel to be rotated by the spindle via the second wheel.

The base includes a coupling element engaged onto the first wheel and the second wheel, to couple the first wheel and the second wheel together. The base includes a brake device attached thereto, and provided to brake the first wheel.

The base includes a frame disposed thereon, and a seat support on the frame for supporting the users. The frame includes a rail provided on top thereof, for slidably and adjustably supporting the seat.

The frame includes a lever rotatably secured thereto, and a pressing member rotatably attached to the lever and engaged with either of the first and the second coupling members, to straighten and tighten the first and the second coupling members. The frame includes a spring member engaged with the lever, to bias the pressing member to engage with and to force against the coupling member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
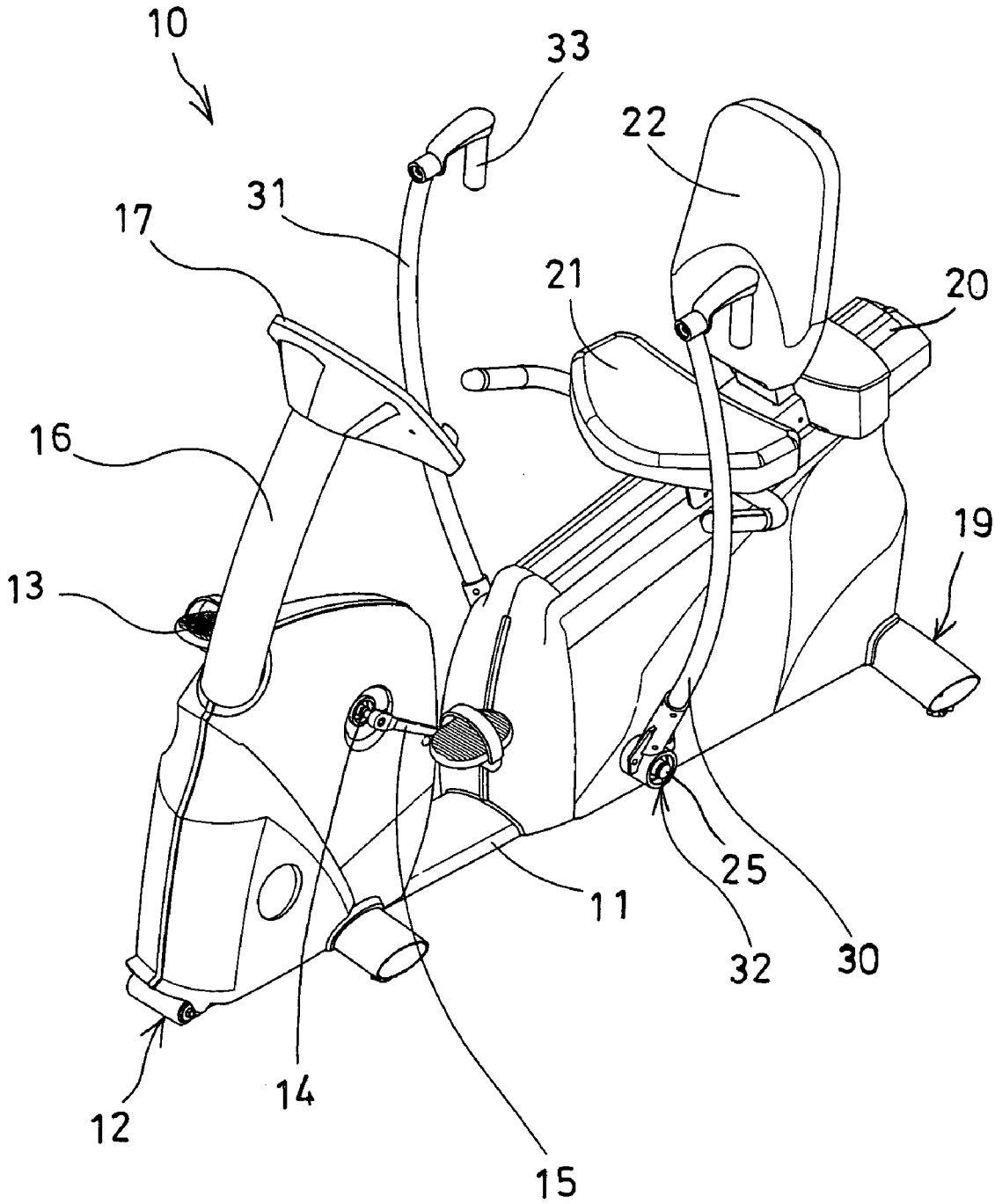
FIG. 1 is a perspective view of a compound bicycle exercising device in accordance with the present invention.
Figure 2:
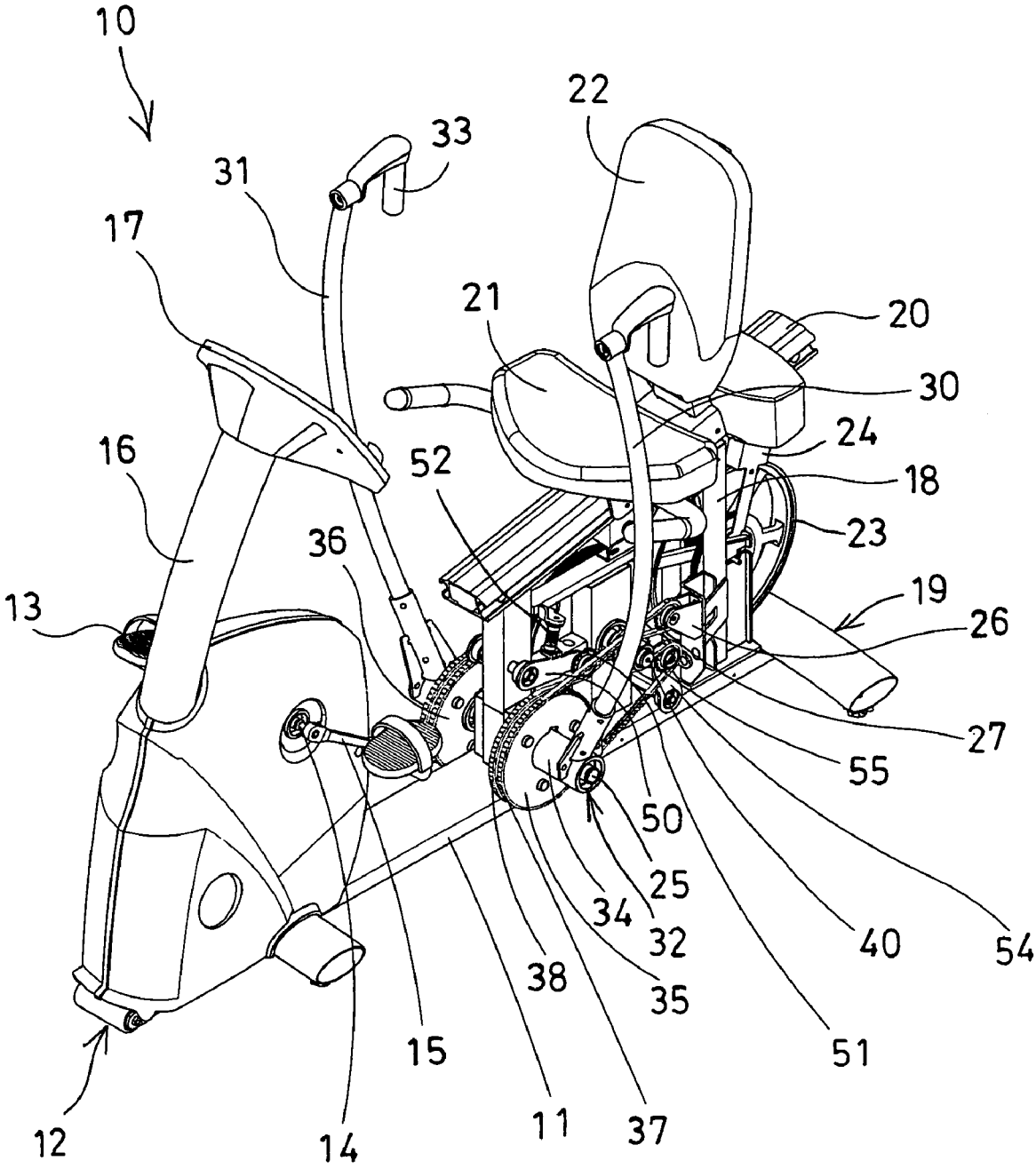
FIG. 2 is a perspective view of the compound bicycle exercising device, similar to FIG. 1, in which a portion of the outer cover has been removed to show an inner structure of the exercising device.
Figure 3:
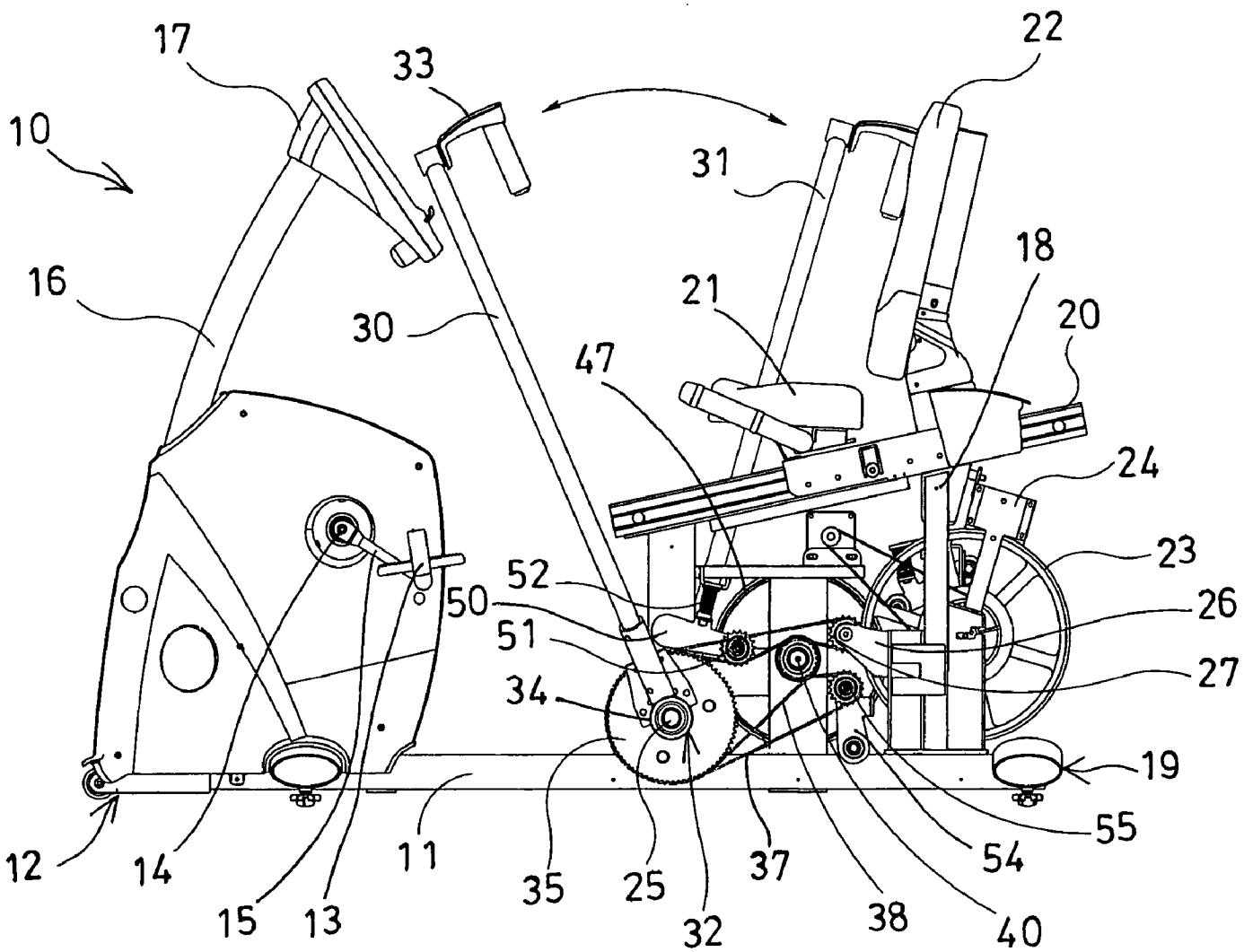
FIG. 3 is a side elevational view of the compound bicycle exercising device as shown in FIG. 2.
Figure 4:
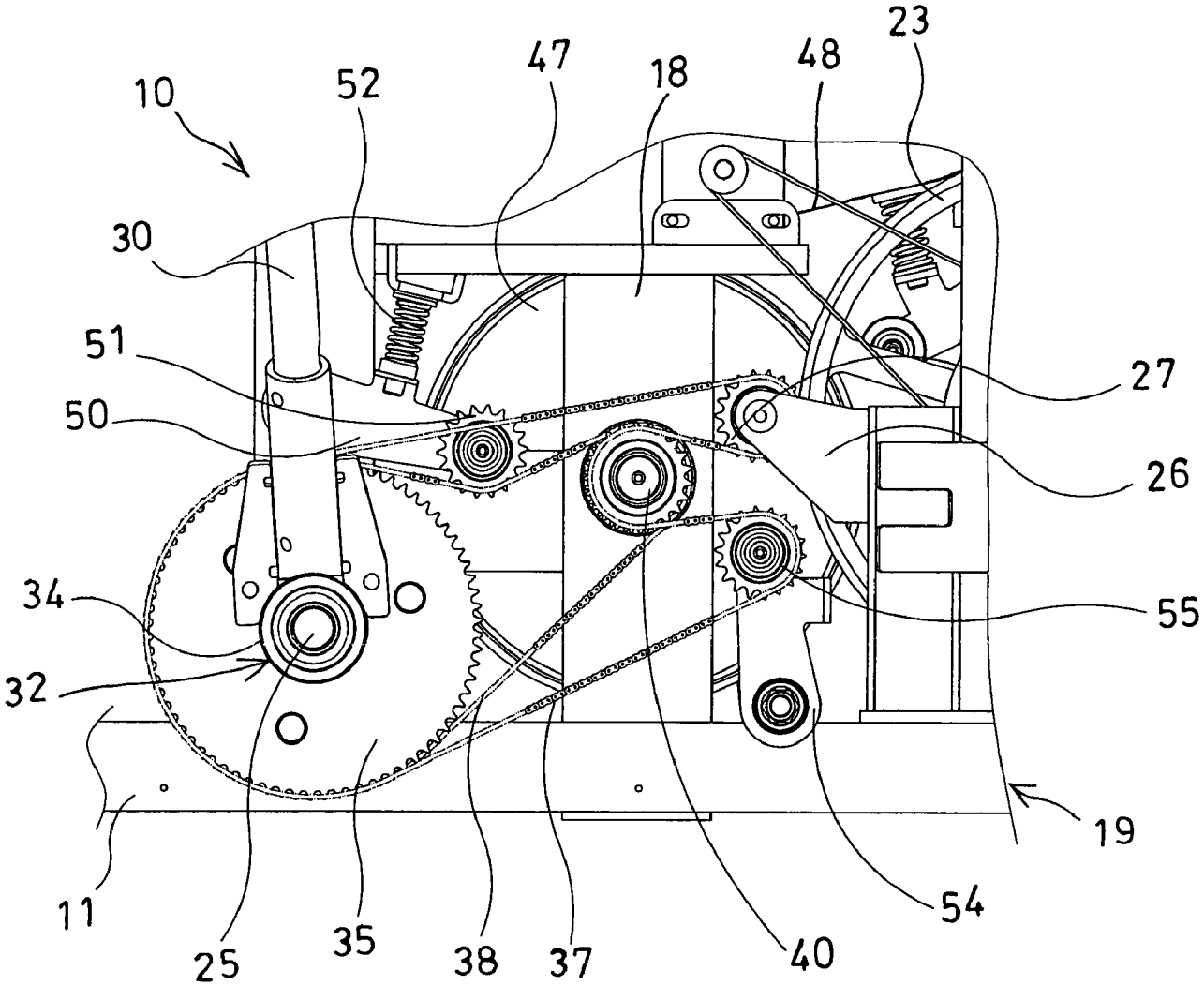
FIG. 4 is an enlarged partial side elevational view of the compound bicycle exercising device.

Referring to the drawings, and initially to FIGS. 1-5, a compound bicycle exercising device 10 in accordance with the present invention comprises a base 11 including a pair of foot pedals 13 rotatably attached to a front portion 12 of the base 11 with a conventional spindle 14 and cranks 15, for being driven or operated by the users to conduct the conventional cycling exercises, and including a post 16 provided or extended from the front portion 12 of the base 11 and having a control device or a control panel 17 provided on top thereof.

The compound bicycle exercising device 10 further includes a frame 18 disposed on a rear portion 19 of the base 11 and having a rail 20 formed or provided on top thereof, for and/or optionally slidably and/or adjustably supporting a seat 21 and/or a seat back 22 thereon, and for supporting the users thereon. A conventional weight or wheel 23 may further be provided and rotatably supported on the base 11, or rotatably attached to the frame 18, and a brake device 24, such as a typical magnetic retarding or braking device 24 may further be provided to brake the wheel 23 by the users, when required.

The compound bicycle exercising device 10 further includes a pair of handle stems 30, 31 each having a lower portion 32 rotatably or pivotally attached to the base 11 with a pivot axle 25, for allowing the handle stems 30, 31 to be pulled and pushed or operated in reciprocating operation by the users, and each having a handgrip 33 rotatably or pivotally attached to an upper portion thereof, for allowing the handle stems 30, 31 to be easily and comfortably pulled and pushed or operated by the users. The pivotal attachment of the handgrips 33 to top of the handle stems 30, 31 has been filed in a co-pending U.S. patent application, and is not related to the present invention, and thus will not be described in further details.

The handle stems 30 each includes a barrel 34 attached or secured to the lower portion 32 thereof, and two sprockets or gears or pulleys or rotary members 35, 36 secured on the barrel 34 (FIGS. 2, 5) or secured to the handle stems 30 and rotated in concert with the handle stems 30 relative to the pivot axle 25, for allowing the rotary members 35, 36 and the barrel 34 to be rotated relative to the pivot axle 25 by the handle stems 30, 31. Two belts or gears or chains or coupling members 37, 38 may be provided and attached or engaged onto the rotary members 35, 36 respectively, for coupling the rotary members 35, 36 to the other parts or elements which will be discussed hereinafter.

The compound bicycle exercising device 10 further includes a spindle 40 provided on or attached to or supported on the base 11, such as rotatably attached to the frame 18 of the base 11, and having two end portions 41, and includes two sprockets or gears or pulleys or rotary members or followers 42, 43 rotatably attached onto each of the end portions 41 of the spindle 40 with unidirectional bearings 44, 45 (FIGS. 5 and 6) and coupled to the rotary members 35, 36 with the coupling members 37, 38, for allowing the followers 42, 43 to be rotated relative to the spindle 40 by the handle stems 30, 31, via the followers 42, 43 and the coupling members 37, 38 and the rotary members 35, 36 and the barrel 34.

Figure 5:
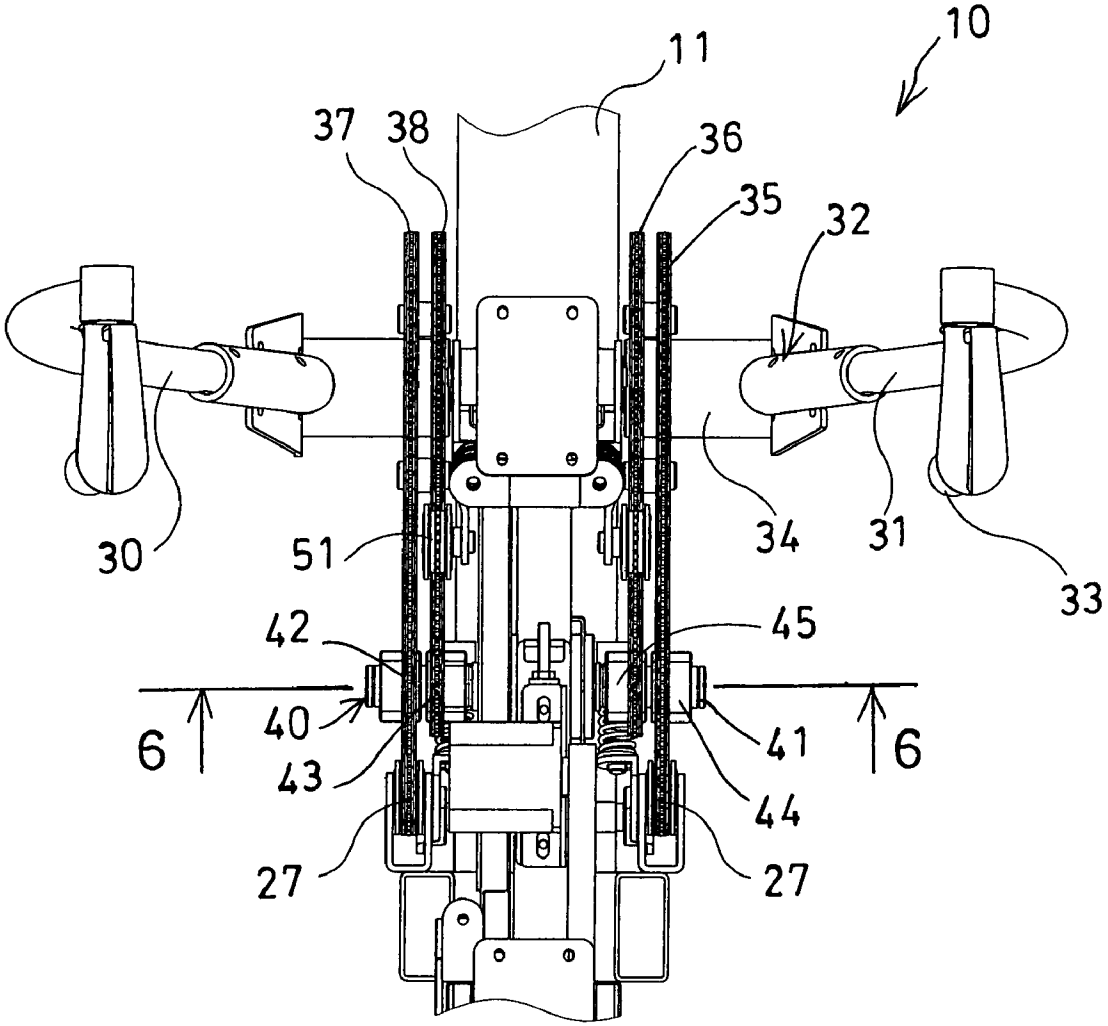
FIG. 5 is an enlarged partial top plan view of the compound bicycle exercising device.
Figure 6:
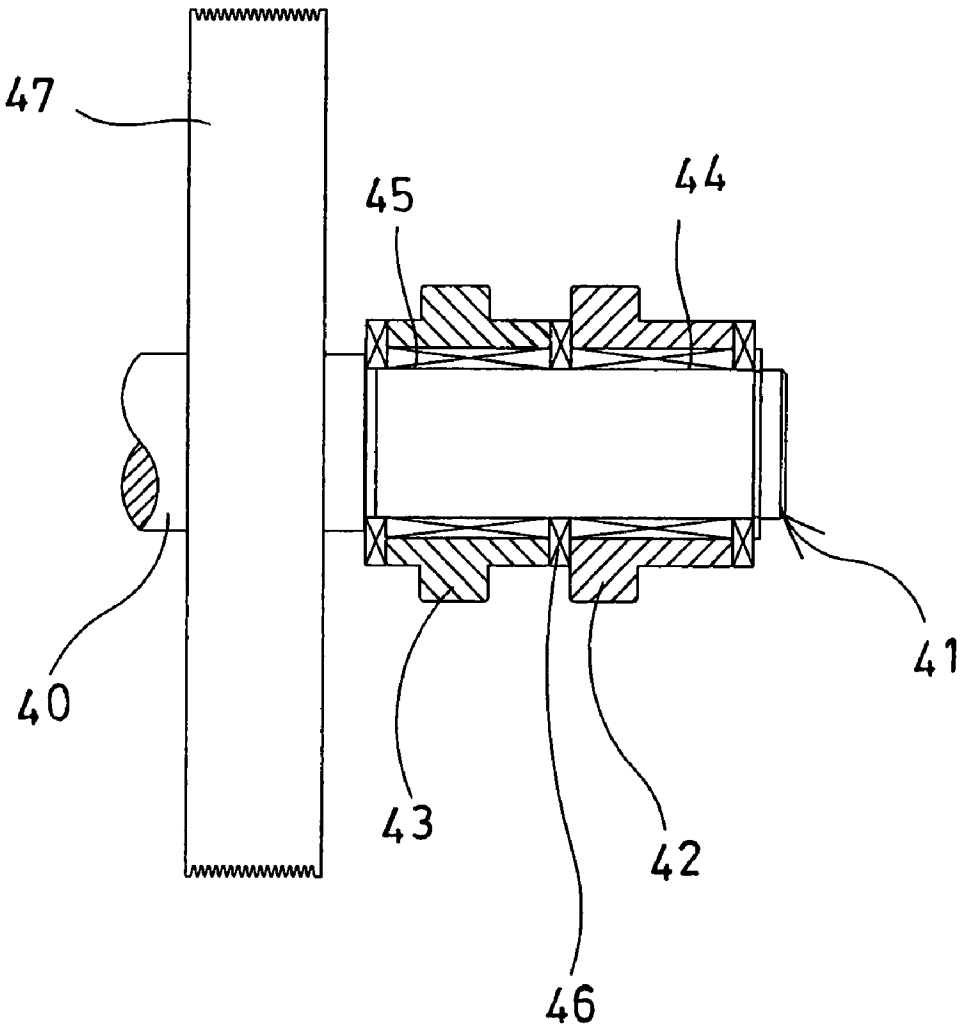
FIG. 6 is an enlarged partial cross sectional view of the compound bicycle exercising device taken along lines 6-6 of FIG. 5.

As shown in FIGS. 5 and 6, the unidirectional bearings 44, 45 for the followers 42, 43 are provided for allowing the spindle 40 to be continuously rotated and driven by the followers 42, 43 alternatively. However, it is to be noted that the spindle 40 is required to be continuously rotated and driven by the followers 42, 43 in an active direction, but the handle stems 30, 31 will be rotated relative to the pivot axle 25 forwardly and rearwardly, or in both the active direction and the reverse direction, and in reciprocating action and alternatively.

For allowing the spindle 40 to be continuously rotated and driven by the followers 42, 43 in the active direction by rotating the handle stems 30, 31 forwardly and rearwardly or alternatively, a lever 26 is required to be provided and rotatably secured or attached onto the frame 18 of the base 11, and includes a sprocket or pulley or rotary element 27 rotatably attached to a free end thereof (FIGS. 2-4 and 7-8) or directly and rotatably attached to the frame 18 of the base 11, and engaged with the coupling members 37, and arranged to have the spindle 40 to be located between the rotary member 35 and the rotary element 27, and/or arranged to have the coupling member 37 to engage over the rotary member 35 and then the rotary element 27 and then to engage over the follower 42, to allow the spindle 40 and the rotary member 35 to be rotated in different direction.

Figure 7:
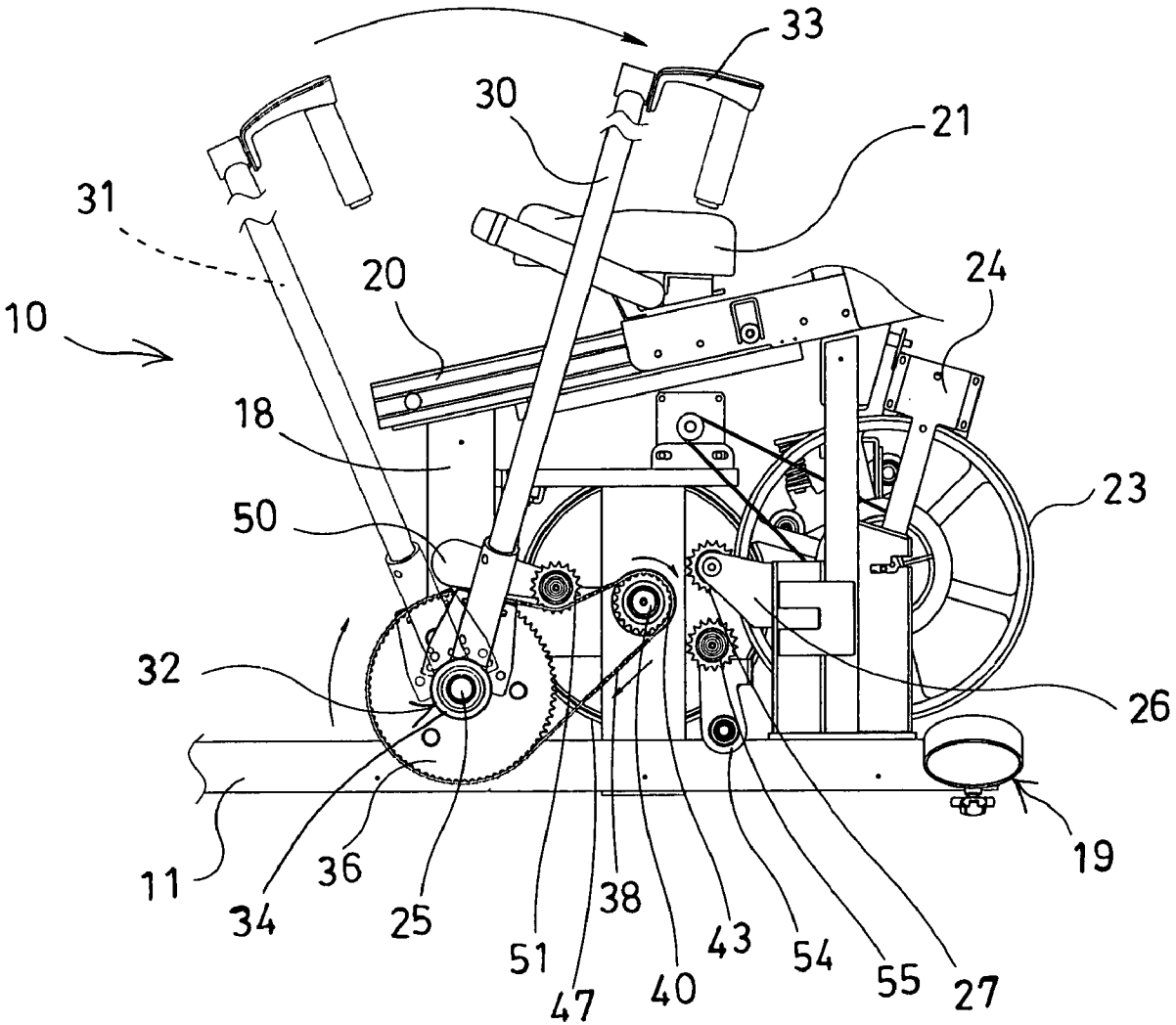
FIGS. 7 and 8 are enlarged partial side elevational views, illustrating the operation of the compound bicycle exercising device.
Figure 8:
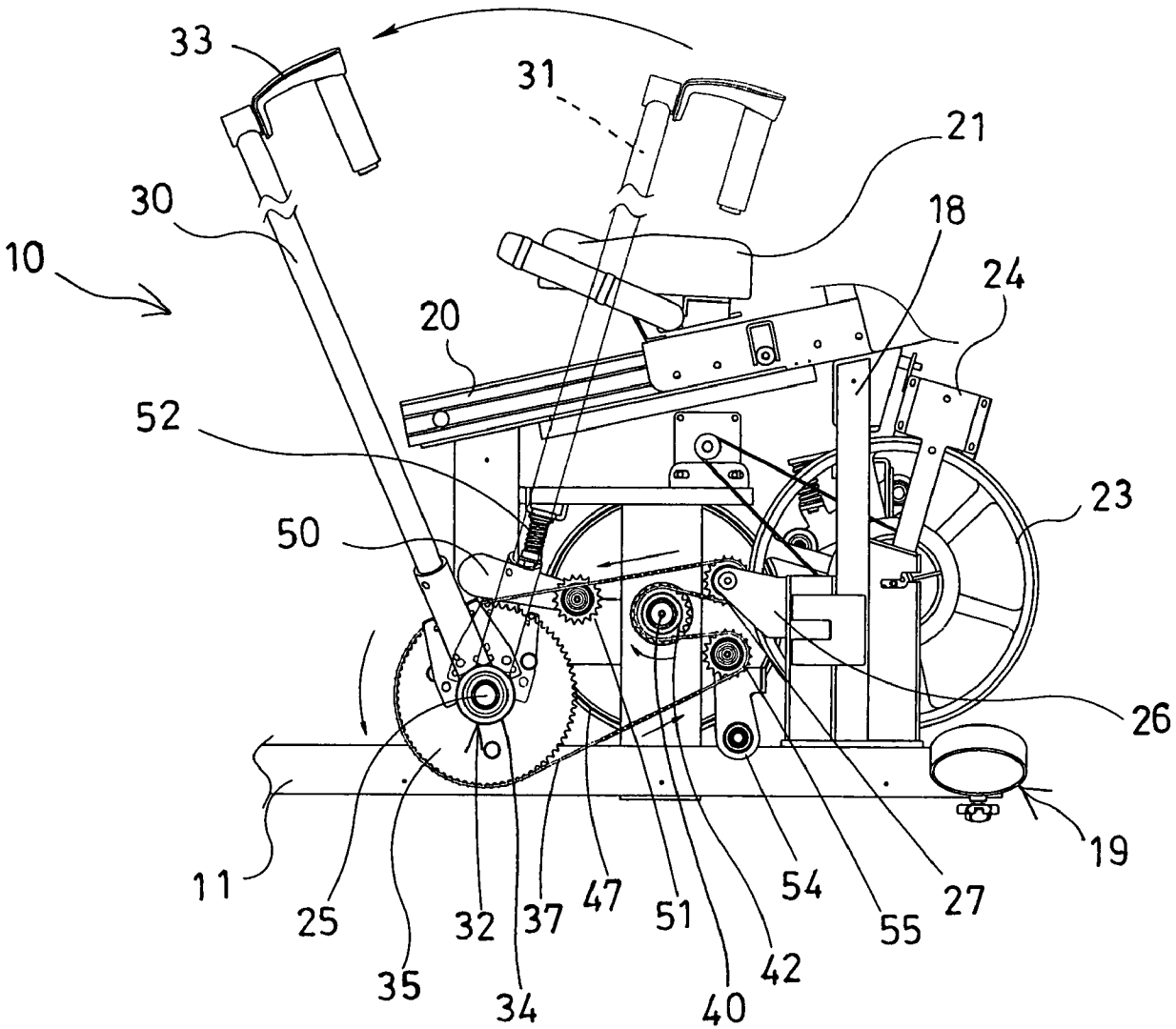

For example, as shown in FIG. 8, when the rotary member 35 is rotated counterclockwise by the handle stems 30, 31, the spindle 40 may be rotated clockwise, or in the active direction, by the rotary member 35 and the rotary element 27 and the follower 42; and as shown in FIG. 7, the spindle 40 may also be rotated clockwise, or in the active direction, by the other rotary member 36 and the other follower 43 and the other coupling member 38, such that the spindle 40 may be continuously rotated and driven by the followers 42, 43 in the active direction by rotating the handle stems 30, 31 forwardly and rearwardly or alternatively.

In operation, as shown in FIGS. 7 and 8, the handle stems 30, 31 may be rotated relative to the pivot axle 25 and may be pulled toward and pushed away from the users and the seat 21 in reciprocating action and alternatively, in order to continuously rotate and drive the spindle 40 in the active direction, and to train the upper muscle groups of the users. A thrust bearing 46 is preferably provided and disposed between the unidirectional bearings 44, 45 and the followers 42, 43 (FIG. 6), for suitably separating the followers 42, 43 away from each other, and for preventing the followers 42, 43 from acting or from being contact with each other.

As shown in FIGS. 3-4 and 6-8, another follower or weight or wheel 47 may further be provided and secured on the spindle 40, and rotated in concert with the spindle 40, for allowing the wheel 47 to be rotated and driven by the handle stems 30, 31, via the followers 42, 43 and the spindle 40. The wheel 47 may then be coupled to the wheel 23 with a belt or gearing device or chain or coupling element 48 (FIG. 4), for allowing the wheel 23 to be rotated and driven by the wheel 47, and thus for allowing the wheel 23 to provide or to apply a resistive force against the spindle 40 and thus the handle stems 30, 31.

A lever 50 may further be provided and rotatably secured or attached onto the frame 18 of the base 11, and includes another sprocket or pulley or rotary member or follower or pressing member 51 rotatably attached to a free end thereof (FIGS. 2-4 and 7-8), and engaged with either of the coupling members 37, 38, such as the coupling member 38, and a spring member 52 may be engaged with the lever 50, for biasing the pressing member 51 to engage with or to force against the coupling member 38, in order to straighten or tighten the coupling member 38, and thus to allow the rotary member 36 and the follower 43 to be solidly coupled together with the coupling member 38, and thus to prevent the coupling member 38 from being disengaged from the rotary member 36 and the follower 43.

Similarly, one or more levers 54 may further be provided and rotatably secured or attached onto the frame 18 of the base 11, and each includes another sprocket or pulley or rotary member or pressing member 55 rotatably attached to a free end thereof (FIGS. 2-4 and 7-8), and engaged with either of the coupling members 37, 38, such as the other coupling member 37, and may also be biased to engage with or to force against the coupling member 37, in order to straighten or tighten the coupling member 37, and thus to allow the rotary member 35 and the follower 42 to be solidly coupled together with the coupling member 37, and thus to prevent the coupling member 37 from being disengaged from the rotary member 35 and the follower 42.

In operation, the spindle 40 may be continuously rotated and driven in the active direction by both the handle stems 30, 31 that are rotated relative to the pivot axle 25 and pulled toward and pushed away from the users and the seat 21 in reciprocating action and alternatively, via the rotary members 35, 36 and the followers 42, 43 and the coupling members 37, 38.

Accordingly, the compound bicycle exercising device in accordance with the present invention includes a coupling or transmission device for continuously rotating or driving the spindle and the weight or the wheel in the active direction by rotating the handle stems 30, 31 in reciprocating action and alternatively, by both pushing or moving the handle stems forwardly and pulling the handle stems rearwardly, and thus for allowing the compound bicycle exercising device to be suitably or effectively operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A compound bicycle exercising device comprising:

a base;

a pair of foot pedals rotatably attached to said base via a spindle and cranks;

a right handle stem and a left handle stem, each having an upper portion and a lower portion pivotally attached to said base with a pivot axle, said handle stems reciprocate back and forth when pushed and pulled by a user;

a first rotary member and a second rotary member secured coaxially to said lower portion of the right handle stem, and a third rotary member and a fourth rotary member secured coaxially to said lower portion of the left handle stem wherein the rotary members rotate in concert with said handle stems relative to said pivot axle;

a second spindle, rotatably supported on said base, includes two end portions, each end portion having a first follower and a second follower rotatably attached thereon with unidirectional bearings;

a first coupling member and a second coupling member coupled to said first and second rotary members respectively and first and second followers respectively on one end of the second spindle, and a third coupling member and a fourth coupling member coupled to said third and fourth rotary members respectively and first and second followers respectively on the other end of the second spindle wherein the second rotary member and the third rotary member rotate the second spindle in a first direction; and a pair of rotary elements, one engaged with said first coupling member and the other engaged with said fourth coupling member, is arranged so that when said first and fourth rotary members are rotated in a second direction opposite to said first direction, the first and fourth rotary members still drive the second spindle such that said second spindle is continuously rotated and driven when said handle stems are rotated in the first direction and the second direction.

2. The compound bicycle exercising device as claimed in claim 1, wherein said handle stems each includes a barrel secured to said lower portion thereof, and said rotary members are secured on said barrels respectively and thus secured to said handle stems and rotated in concert with said handle stems respectively.

3. The compound bicycle exercising device as claimed in claim 1, wherein said handle stems each includes a handgrip attached to said upper portion thereof.

4. The compound bicycle exercising device as claimed in claim 1, wherein said base includes a first wheel rotatably supported thereon, and said second spindle includes a second wheel secured thereto and rotated in concert with said second spindle and coupled to said first wheel, to allow said first wheel to be rotated by said second spindle via said second wheel.

5. The compound bicycle exercising device as claimed in claim 4, wherein said base includes a coupling element engaged onto said first wheel and said second wheel, to couple said first wheel and said second wheel together.

6. The compound bicycle exercising device as claimed in claim 4, wherein said base includes a brake device attached thereto, and provided to brake said first wheel.

7. The compound bicycle exercising device as claimed in claim 1, wherein said base includes a frame disposed thereon, and a seat support on said frame for supporting a user.

8. The compound bicycle exercising device as claimed in claim 7, wherein said frame includes a rail provided on top thereof, for slidably and adjustably supporting said seat.

9. The compound bicycle exercising device as claimed in claim 7, wherein said frame includes a pair of levers rotatably secured thereto, and a pressing member rotatably attached to each said lever and engaged with either of said first and said second coupling members, to straighten and tighten said first and said second coupling members or either of said third and fourth coupling members.

10. The compound bicycle exercising device as claimed in claim 9, wherein said frame includes a spring member engaged with each said lever, to bias said pressing member to engage with and to force against said coupling members.

* * * * *